US007676185B2

(12) United States Patent
Tsuji et al.

(10) Patent No.: US 7,676,185 B2
(45) Date of Patent: Mar. 9, 2010

(54) TONER CONTAINER AND IMAGE FORMING APPARATUS INCLUDING SAME

(75) Inventors: Akiko Tsuji, Kameyama (JP); Takahiko Kimura, Ikoma (JP); Masanobu Deguchi, Kashiba (JP); Kazuya Koyama, Ikoma (JP); Hiroshi Kubota, Kadoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 321 days.

(21) Appl. No.: 11/877,060

(22) Filed: Oct. 23, 2007

(65) Prior Publication Data

US 2008/0102397 A1 May 1, 2008

(30) Foreign Application Priority Data

Oct. 27, 2006 (JP) ..... 2006-293237

(51) Int. Cl.
*G03G 15/08* (2006.01)

(52) U.S. Cl. ..... 399/262

(58) Field of Classification Search ..... 222/DIG. 1; 399/258, 259, 260, 262, 263
See application file for complete search history.

(56) References Cited

U.S. PATENT DOCUMENTS

| | | | | |
|---|---|---|---|---|
| 5,774,772 | A | 6/1998 | Kai et al. | |
| 6,275,675 | B1 * | 8/2001 | Cornelius | 399/262 |
| 7,580,658 | B2 * | 8/2009 | Mihara et al. | 399/262 |

FOREIGN PATENT DOCUMENTS

| | | |
|---|---|---|
| JP | 58-38161 | 3/1983 |
| JP | 8-110691 | 4/1996 |
| JP | 2004-144854 | 5/2004 |

* cited by examiner

*Primary Examiner*—Hoang Ngo
(74) *Attorney, Agent, or Firm*—Nixon & Vanderhye, P.C.

(57) ABSTRACT

A toner container of the present invention includes a cylindrical portion containing toner used in an electrophotographic type complex machine. When the cylindrical portion is driven to rotate, the toner gets out via an outlet thereof. The cylindrical portion of the toner container has an inner wall provided with a coat layer containing fluorine-containing silica fine particles, which are obtained by modifying a property of the surfaces of silica fine particles by using a fluorine-based silane coupling agent. This coat layer effectively prevents the toner from being adhered to the inner wall of the toner container.

6 Claims, 4 Drawing Sheets

TONER CONTAINER AND IMAGE FORMING APPARATUS INCLUDING SAME

This Nonprovisional application claims priority under 35 U.S.C. §119(a) on Patent Application No. 2006/293237 filed in Japan on Oct. 27, 2006, the entire contents of which are hereby incorporated by reference.

FIELD OF THE INVENTION

The present invention relates to (i) a toner container for containing toner used in an electrophotographic apparatus and (ii) an image forming apparatus including the toner container.

BACKGROUND OF THE INVENTION

In an electrophotographic type image forming apparatus, a developing device uses toner to visualize an electrostatic latent image formed on the surface of a photoconductor. The toner thus used for the visualization of the electrostatic latent image is contained in a toner bottle, and the toner is sequentially supplied from the toner bottle to the developing device.

In many cases, the toner bottle has a cylindrical shape having a hollow, and has one closed end portion and the other end portion around which an outlet is provided. Further, the toner bottle has an inner circumferential surface on which a plurality of projecting sections having a spiral shape are provided. Such a toner bottle is disposed in an image forming apparatus such that the axis of the cylindrical shape portion is horizontal.

When the toner bottle is driven to rotate with respect to the axis, the projecting sections provided in the inner circumferential surface guides and transports the toner toward the outlet, with the result that toner having an amount corresponding to the rotation gets out from the outlet.

In the image forming apparatus including such a toner bottle, the toner in the toner bottle is likely to be aggregated and adhered to the inner wall of the bottle, so that it is impossible to use the toner fully. This is problematic.

In order to avoid this problem, Patent Document 1 proposes that a lining layer made of a fluorine resin is provided on the inner surface of a toner container.

The toner container is manufactured by winding a fluorine resin film on the outer circumferential surface of a container main body and further winding paper thereon. Hence, such a toner container has a problem with its strength.

Meanwhile, Patent Document 2 proposes that fluorine-based resin particles are adhered to the inner wall of a toner bottle and a stirring member.

Specifically, in Patent Document 2, the inner wall of the toner bottle is coated with vinylidene fluoride polymer particles, tetrafluoroethylene polymer particles, trifluoroethylene polymer particles, fluoroethylene polymer particles, or the like, each of which has a primary particle average diameter of approximately 0.3 μm.

It is understood that this makes it difficult for toner to be adhered to the inner wall of the toner bottle, thereby preventing the adhesion and aggregation of toner.

As an alternative way, there is a method of adding an external additive such as colloidal silica or a flow improver to the toner.

For such an external additive, Patent Document 3 proposes an external additive made of fumed silica that is surface-treated by using fluorine-containing silane coupling agent and hexamethyldisilazane. Such external additives improve flowability of toner, thereby preventing the adhesion and aggregation of toner.

Patent Document 1: Japanese Unexamined Utility Model Publication "Jitsukaisho 58-38161 (published on Mar. 12, 1983)"

Patent Document 2: Japanese Unexamined Patent Publication "Tokukaihei 8-110691 (published on Apr. 30, 1996)"

Patent Document 3: Japanese Unexamined Patent Publication "Tokukai 2004-144854 (published on May 20, 2004)"

However, in an image forming apparatus carrying out fast image formation, the aforesaid technique of Patent Document 2 cannot sufficiently prevent the aggregation and adhesion of toner.

In recent years, as image forming apparatuses become capable of fast image formation, characteristics of toner have been modified. Specifically, toner is modified to melt at a low melting point such that a fixing device quickly fixes the toner onto a recording sheet. This decreases heat resistance of toner, and the toner becomes therefore easily reactive with the inner wall of the toner bottle. For this reason, toner in the vicinity of the inner wall of the toner bottle is easily adhered to the inner wall.

The technique of Patent Document 2 has no problem in the case of toner used in an image forming apparatus carrying out slow image formation, but cannot sufficiently prevent the adhesion and aggregation in the case of an image forming apparatus carrying out fast image formation.

SUMMARY OF THE INVENTION

An object of the present invention is to provide (i) a toner container that prevents toner from being adhered to its inner wall, and (ii) an image forming apparatus including the toner container.

To achieve the object, a toner container of the present invention, including a cylindrical portion, which contains toner used in an electrophotographic type image forming apparatus and is driven to rotate so as to let the toner out via the outlet, includes: a layer, which is provided on an inner wall of the cylindrical portion and contains a fluorine-containing particle obtained by coupling a surface of a silica particle with a fluorine compound.

As such, the layer containing the fluorine-containing particle is provided on the inner wall of the cylindrical portion of the toner container, so that it is possible to prevent the toner from being adhered to the inner wall of the cylindrical portion of the toner container. Further, the fluorine-containing particle can be manufactured to have a sufficiently small particle diameter with ease, by using a silica particle having a small particle diameter. Such a silica particle having a small particle diameter is available or manufactured with ease. Thus, as compared with the technique of Patent Document 2, it is possible to prevent the adhesion of toner more effectively.

Further, an image forming apparatus of the present invention includes: the toner container; a driving section for driving to rotate the cylindrical portion of the toner container; and an image forming section for forming an image in accordance with an electrophotographic method by using the toner getting out via the outlet.

The image forming apparatus includes the aforesaid toner container, and can therefore effectively use the toner through its life, thereby attaining resource saving.

Additional objects, features, and strengths of the present invention will be made clear by the description below. Further, the advantages of the present invention will be evident from the following explanation in reference to the drawings.

DESCRIPTION OF THE EMBODIMENTS

Embodiment

The present invention is applicable to, e.g., a toner bottle used in an electrophotographic type image forming apparatus.

One embodiment of the present invention will be explained below with reference to FIG. 1 to FIG. 4. Note that the present invention is not limited to this.

Figure 2:
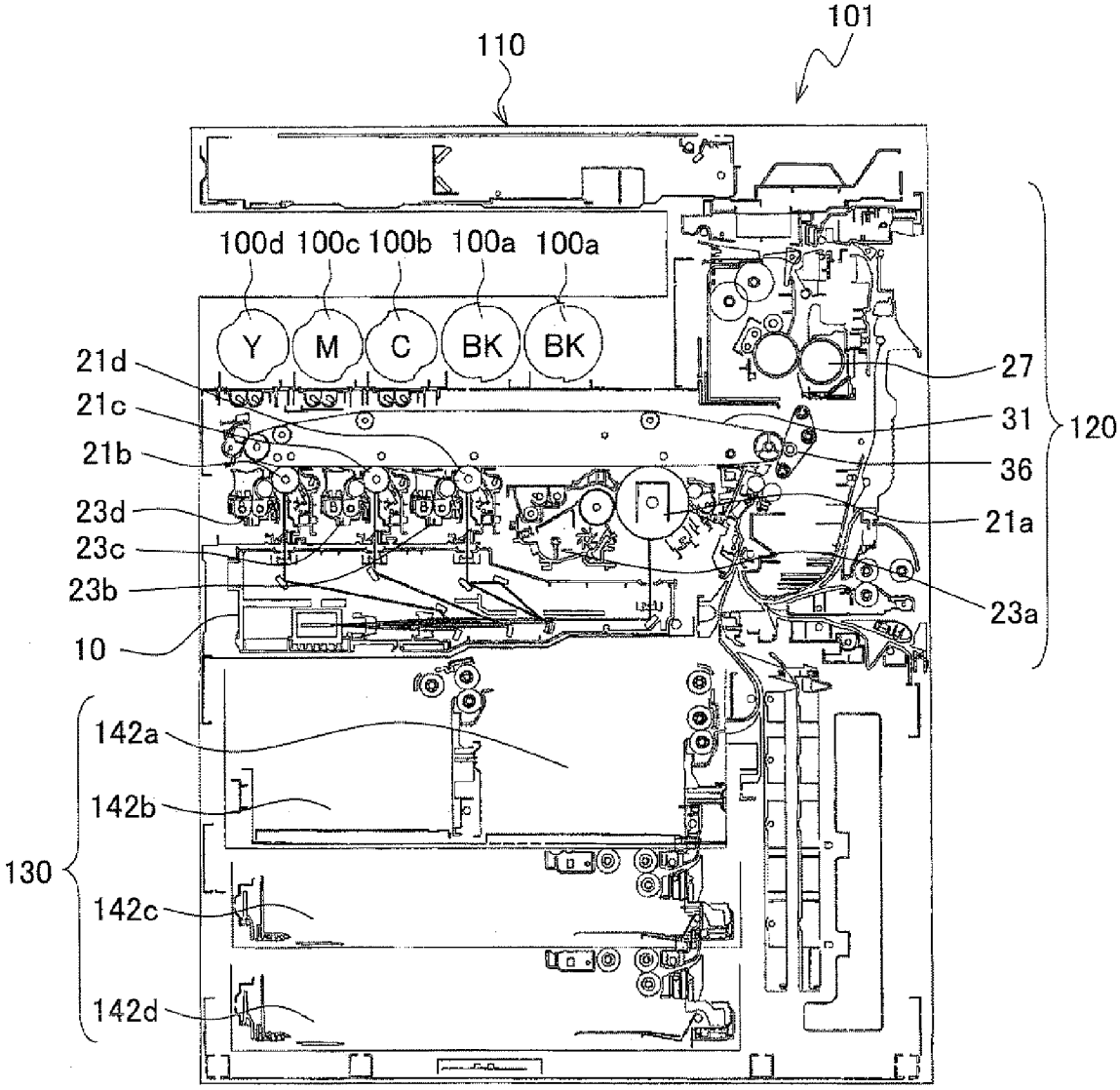
FIG. 2 illustrates one embodiment of the present invention, and is a lateral cross sectional view schematically illustrating the structure of a complex machine.

FIG. 2 illustrates the embodiment of the present invention, and is a lateral cross sectional view schematically illustrating the structure of a complex machine. In the present embodiment, the complex machine is exemplified as an image forming apparatus of the present invention; however, the present invention is not limited to this. The image forming apparatus may be any apparatus carrying out image formation in accordance with the electrophotographic method, such as a printer, a facsimile, or a copying machine.

Such a complex machine 101 of the present embodiment employs the electrophotographic method to form a multi-color image or a single-color image on a recording sheet in accordance with either (i) a print job transmitted from an information processing apparatus (not shown), such as a personal computer, connected from outside, or (ii) image data obtained by scanning a document with a document scanning unit.

As shown in FIG. 2, the complex machine 101 is mainly made up of the document scanning unit 110, an image forming unit (image forming section) 120, and a sheet feeding unit 130. The sheet feeding unit 130 includes 4 sheet-cassettes 142*a* to 142*d* for containing sheets.

The image forming unit 120 forms, in accordance with the electrophotographic method, an image on a recording sheet supplied from any of the sheet-cassettes of the sheet feeding unit 130. The document scanning unit 110 scans a document set on a document table, so as to create image data.

More specifically, the image forming unit 120 puts toner images of black (BK), cyan (C), magenta (M), and yellow (Y) on top of one another so as to form a multi-color image. For the formation, the image forming unit 120 includes four photoconductor drums 21*a* to 21*d* respectively corresponding to BK, C, M, and Y. Provided in the vicinity of the photoconductor drums 21*a* to 21*d* are: charging devices, developing devices, transferring rollers, and cleaning members for the photoconductor drums, respectively. As such, the image forming unit 120 is a tandem type color image forming unit.

The image forming unit 120 further includes an exposure unit 10, an intermediate transferring belt 31, a transferring roller 36, a fixing device 27, and the like. Each of the photoconductor drums 21*a* to 21*d* is, e.g., an organic photosensitive member using an organic photoconductor (OPC).

In the exposure unit 10, laser light beams emitted from the laser scanning unit pass through the polygon mirror and the fθ lens, are reflected by the reflecting mirror, and are irradiated onto the photoconductor drums 21*a* to 21*d* so as to correspond to their colors respectively.

Each of the developing devices 23*a* to 23*d* includes a developer tank, a stirring roller, a developing roller, a doctor blade, and the like. Each of the developing devices 23*a* to 23*d* carries out development by using a two-component developer in which carrier is mixed with toner. Each of the developing devices 23*a* to 23*d* carries out development as follows: toner supplied to the inside of the developer tank is mixed with carrier by using the stirring roller, a magnetic brush adjusted by the doctor blade to have an appropriate brush height is formed on the developing roller, and the magnetic brush is brought into contact with each of the photoconductor drums 21*a* to 21*d* under a developing bias voltage.

In order to supply toner of respective colors to the developing device 23*a* to 23*d*, the complex machine 101 includes toner supplying units 100*a* to 100*d*, which are provided above the developing devices 23*a* to 23*d*. The toner supplying units 100*a* to 100*d* include toner bottles respectively containing black (BK) toner, cyan (C) toner, magenta (M) toner, and yellow (Y) toner. Each of the toner bottles is replaceable when the toner therein is run out.

Note that the complex machine 101 includes two toner supplying units 100*a* each containing black toner, which is consumed a lot. Further, the toner bottles of the toner supplying units 100*a* to 100*d* may contain appropriate amounts of carrier in addition to the toner of the colors, respectively.

The intermediate transferring belt 31 is an endless belt suspended by a driving roller and a passive roller, and is in contact with the respective surfaces of the photoconductor drums 21*a* to 21*d*. Further, the intermediate transferring belt 31 is in contact with a sheet transportation path. In the location where the intermediate transferring belt 31 meets the sheet transportation path, the transferring roller 36 is provided so as to face the intermediate transferring belt 31.

The fixing device 27 includes a fixing roller and a pressure roller. They sandwich a recording sheet onto which a toner image has been transferred, so as to fix the toner image onto the recording sheet.

Explained next is an image formation process in the complex machine 101.

First, each of the surfaces of the photoconductor drums 21*a* to 21*d* is uniformly charged by a charging device. Then, the uniformly charged surfaces of the photoconductor drums 21*a* to 21*d* are exposed by the exposure unit 10, with the result that electrostatic latent images are formed on the surfaces of the photoconductor drums 21*a* to 21*d*. The electrostatic latent images are formed so as to correspond to color components of the image, respectively.

The electrostatic latent images corresponding to the color components and formed on the photoconductor drums 21*a* to 21*d* are developed by the developing devices 23*a* to 23*d*, with the result that a BK toner image, a C toner image, a M toner image, and a Y toner image are formed on the surfaces of the photoconductor drums 21*a* to 21*d* respectively. The toner images formed on the surfaces of the photoconductor drum 21*a* to 21*d* and corresponding to the colors are transferred onto the intermediate transferring belt 31 so as to be on top of each other. With this, a desired multi-color image is formed on the intermediate transferring belt 31 as a toner image.

Meanwhile, one recording sheet is picked up from any of the sheet-cassettes of the sheet feeding unit 130, and is transported via the sheet transportation path. The recording sheet thus transported reaches the point where the transferring roller 36 is provided, and is pressed against the intermediate transferring belt 31 by the transferring roller 36. Here, a transfer electric field is formed between the transferring roller 36 and the intermediate transferring belt 31, and works to transfer the toner image from the intermediate transferring belt 31 to the recording sheet.

The recording sheet to which the toner image has been transferred is further transported, and the fixing device 27 fixes the toner image onto the recording sheet. Then, the recording sheet is ejected to an ejection tray, thus ending the image formation process.

Figure 1:
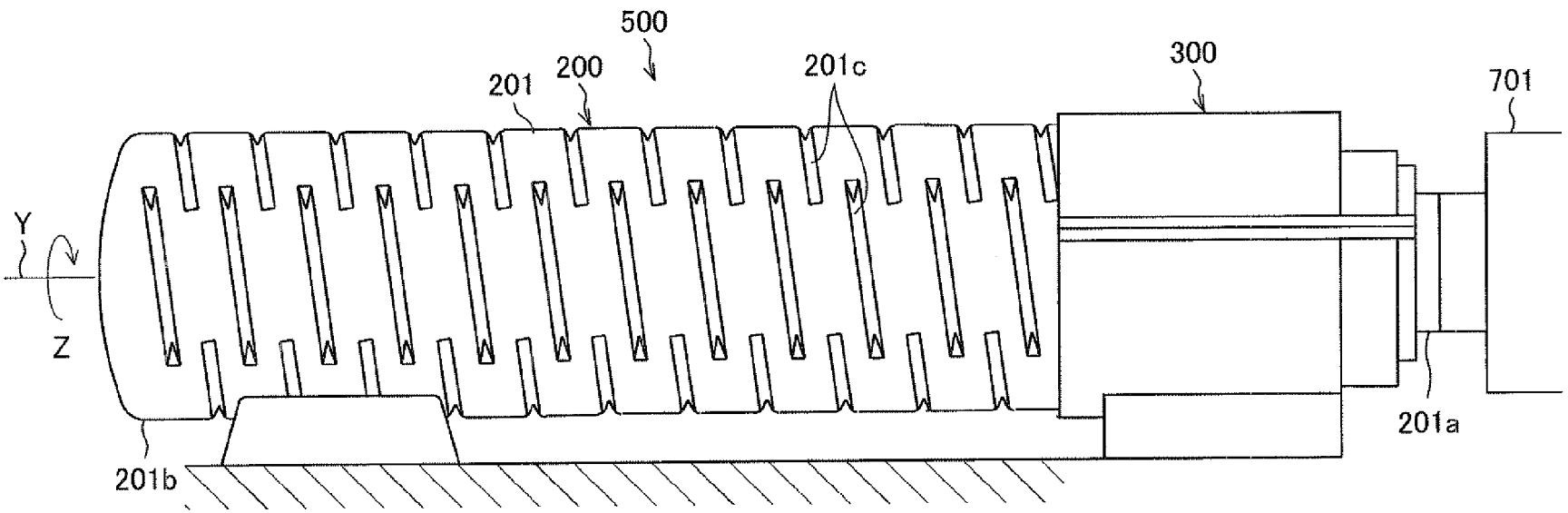
FIG. 1 illustrates one embodiment of the present invention, and is a lateral view illustrating the structure of a toner container.

FIG. 1 illustrates one embodiment of the present invention, and is a lateral view illustrating the structure of a toner container 500. As shown in FIG. 1, the toner container 500 includes (i) a toner bottle 200 containing therein toner, which is a developer, and (ii) a bottle holding member 300 having one end portion that rotatably holds the toner bottle 200.

The toner bottle 200 includes a cylindrical portion 201 having a substantially cylindrical shape. The cylindrical portion 201 has a tip end portion 201*a*, which is an end portion held by the bottle holding member 300. In the vicinity of the tip end portion 201*a*, there is formed an outlet via which toner gets out. Note that FIG. 1 does not illustrate the outlet because a region near the outlet in the circumferential surface of the cylindrical portion 201 is covered with the bottle holding member 300 as shown in FIG. 1. Meanwhile, the cylindrical portion 201 has a rear end portion 201*b*, which is a closed end opposite to the tip end portion 201*a*.

Formed on the outer circumferential surface of the cylindrical portion 201 are a plurality of groove portions 201*c* recessed toward inside of the cylindrical portion 201. Viewing from the inner circumferential surface of the cylindrical portion 201, regions corresponding to the groove portions 201*c* serve as projecting sections projecting toward the axis Y.

The plurality of groove portions 201*c* (projecting sections) are provided along the axis Y of the toner bottle 200 such that they extend to slightly incline with respect to the rotation direction of the toner bottle 200 and are parallel to one another. In other words, the projecting sections are in the form of spiral in the inner circumferential surface of the cylindrical portion 201 of the toner bottle 200. Note that the toner bottle 200 including these projecting sections, i.e., the groove portions 201*c* can be formed by molding, e.g., an HDPE (high-density polyethylene) resin.

The toner container 500 is installed in the complex machine 101 in such a manner as shown in FIG. 1, i.e., in such a manner that the axis Y of the cylindrical portion 201 is horizontal. Further, the toner bottle 200 is driven by the rotation driving unit 701 to rotate in the direction Z shown in FIG. 1, with respect to the axis Y of the cylindrical portion 201.

When the toner bottle 200 is driven to rotate, toner contained in the toner bottle 200 is guided by the projecting sections, and is transported from the rear end portion 201*b* side to the tip end portion 201*a* side in which the outlet is provided. When the toner reaches the outlet provided near the tip end portion 201*a*, the toner goes out of the toner bottle 200 to the bottle holding member 300, and is then supplied to each developing device 23 via the base portion of the bottle holding member 300.

Note that the groove portions 201*c* (projecting sections) may have any shapes as long as they can transport the toner from the rear end portion 201*b* side to the tip end portion 201*a* side in the cylindrical portion 201.

Figure 4:
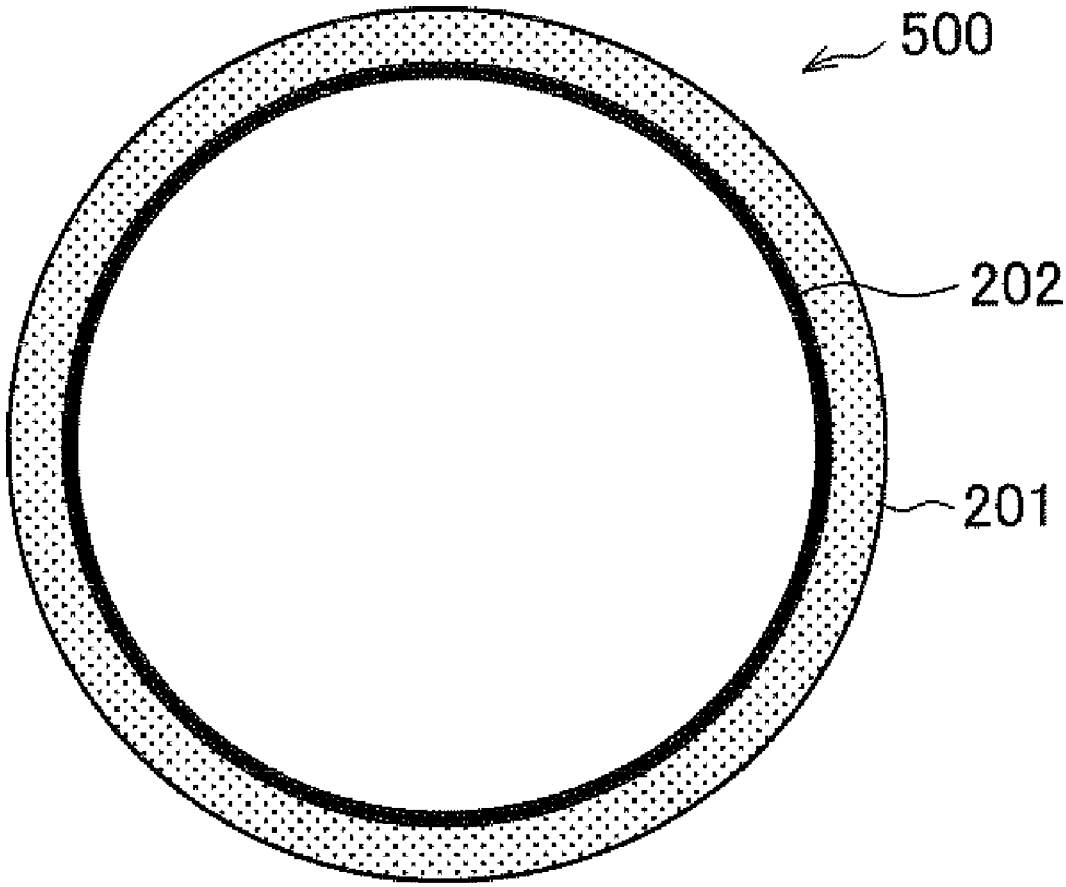
FIG. 4 is a cross sectional view illustrating the toner container shown in FIG. 1.

FIG. 4 is a cross sectional view illustrating the structure of the toner container 500. As shown in FIG. 4, a feature of the toner container 500 lies in that a coat layer 202 containing fluorine-containing silica fine particles (fluorine-containing particles) obtained by coupling surfaces of silica fine particles with a fluorine compound is provided on the inner wall surface of the cylindrical portion 201.

The cylindrical portion 201 is made of, e.g., an HDPE resin, but has fine rises and recesses when the surface thereof is observed by a microscope or the like. In cases where the fine particles are not applied to the cylindrical portion 201, toner fills in the recesses, and is adhered thereto with ease. The coat layer 202 containing the fluorine-containing silica fine particles is formed on the surface of the cylindrical portion 201 so as to fill in the fine recesses and accordingly makes the surface of the cylindrical portion 201 flat, thereby making it difficult for toner to be adhered.

Here, in the technique of Patent Document 2 described above, fluorine based resin particles are adhered to the inner wall of the toner bottle; however, the fluorine-based resin particles described in Patent Document 2 are in several hundreds nano meter order, and it is therefore difficult to make diameters of such fluorine-based resin particles small. This makes it impossible for the fluorine-based resin particles in Patent Document 2 to sufficiently prevent the toner from being adhered to the wall surface.

In contrast, in the present invention, the fluorine-containing silica fine particles obtained by coupling the surfaces of the silica fine particles with the fluorine compound are used, so that it is easy to make the diameters of the fine particles small. This greatly improves the effect of preventing the adhesion of toner onto the wall surface, as compared with the technique of Patent Document 2.

Note that, it is preferable that each of the fluorine-containing silica fine particles have a secondary particle average diameter of not more than 50 nm. As described in Examples below, the use of such fluorine-containing silica fine particles having a small secondary particle average diameter of not more than 50 nm attains a high toner adhesion preventing property.

It is difficult for the fluorine-based resin particles in Patent Document 2 to have such a particle diameter, but the use of the fluorine-containing silica fine particles in the present invention makes it possible that the secondary particle average diameter is not more than 50 nm.

Note that the fluorine-containing silica fine particles can be obtained by, e.g., modifying a property of the surfaces of silica fine particles with the use of fluorine-based silane coupling agent.

As the silica fine particles whose property is to be modified, hydrophobic silica ultrafine particles are preferable. For the silica fine particles, it is possible to use, e.g., R976S or RY300 provided by Nippon Aerosil Co. Ltd, SP-03B or SP-1B provided by Fuso Chemical Co. Ltd, or the like.

Further, for the fluorine-based silane coupling agent, it is possible to various types of publicly known agent whose chemical formula is, for example:

$$CF_3(CF)_5CH_2CH_2Si(OC_2H_5)_3,$$

$$CF_3(CF_2)_2CH_2CH_2Si(OCH_3H_7)_3,$$

$$CF_3(CF_2)_7CH_2CH_2Si(OCH_2H_5)_3, \text{ or}$$

$$CF_3(CF)_7CH_2CH_2Si(OCH_3)_3$$

As for a product of such an agent, it is possible to use KP-801M provided by Shin-Etsu Silicones of Shin-Etsu Chemical Co. Ltd.

Note that the fluorine-based silane coupling agent can be obtained by reacting a silane coupling agent represented by the following general formula with a long-chain fluoroalkyl group represented by the following formula.

(Silane Coupling Agent)

$X—Si(OR)_3$ (X is a vinyl group, an amino group, an epoxy group, or the like; OR is a methoxy group, an ethoxy group, or the like.)

(Long-Chain Fluoroalkyl Group)

$CF_3(CF_2)_n—$

The following explains a method for forming, on the inner wall surface of the cylindrical portion 201 of the toner bottle 200, the coat layer 202 containing the fluorine-containing silica fine particles.

First, a coating liquid is prepared so as to contain silica fine particles, a fluorine-based silane coupling agent, a silicone-acryl-based resin, and a vinyl acetate resin, and include lower alcohol or the like as a solvent.

Note that silica fine particles and fluorine-based silane coupling agent usable for the coating liquid are those described above.

Further, as the silicone-acryl-based resin, KP-546 provided by Shin-Etsu Silicones of Shin-Etsu Chemical Co. Ltd or the like can be used, for example. On the other hand, as the vinyl acetate resin, vinyl roll S provided by Showa Highpolymer Co. Ltd or the like can be used, for example. For the lower alcohol, ethanol or the like can be used.

Figure 3:
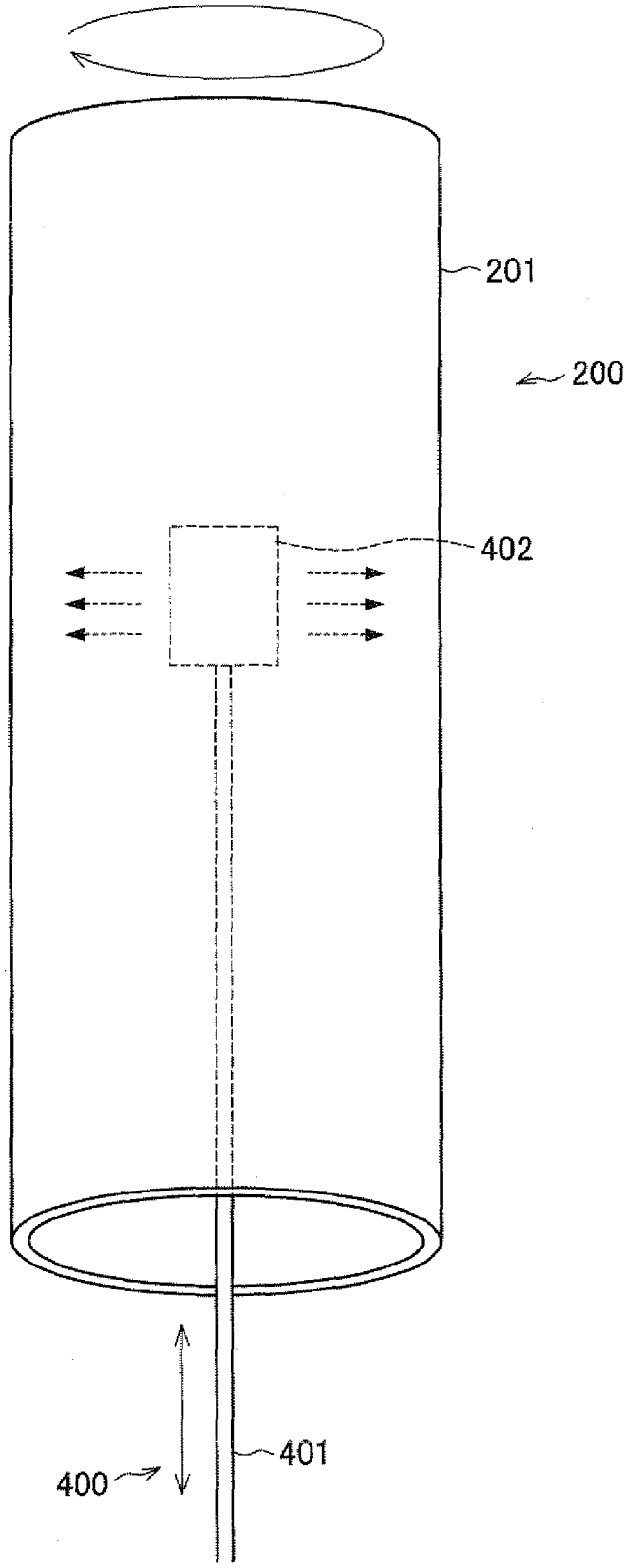
FIG. 3 illustrates one embodiment of the present invention, and is a schematic diagram illustrating a method for applying a coating liquid.

Then, the coating liquid thus prepared is uniformly sprayed to the inner wall of the cylindrical portion 201 of the toner bottle 200. FIG. 3 illustrates one embodiment of the present invention, and is a schematic diagram illustrating a method for applying the coating liquid.

See FIG. 3. In order to spray the coating liquid, a spray apparatus 400 having a nozzle 401 whose tip end portion 402 is provided with a spray hole is used. Specifically, the tip end portion 402 of the nozzle 401 is inserted to the inside of the cylindrical portion 201. Then, the coating liquid is sprayed therefrom while the nozzle 401 is moved up and down at a constant speed and the toner bottle 200 is rotated at a constant speed In this way, the coating liquid is uniformly applied to the inner surface of the cylindrical portion 201 of the toner bottle 200.

After spraying the coating liquid as described above, the toner bottle 200 is sufficiently dried to form, on the inner wall of the cylindrical portion 201 of the toner bottle 200, the coat layer 202 containing the fluorine-containing silica fine particles.

As shown in Examples described later, in cases where the coat layer 202 has a thickness of less than 0.3 μm, the coat layer 202 wears away in a short time, so that it is impossible to maintain the toner adhesion prevention property for a long time.

In the meanwhile, in cases where the thickness of the coat layer 202 exceeds 3 μm, the coat layer 202 is detached with ease. When such a detached coat layer 202 is mixed in the developer, image deterioration is likely to occur.

Hence, it is preferable that the coat layer 202 containing the fluorine-containing silica fine particles have a thickness of not less than 0.3 μm but not more than 3 μm.

Further, it is preferable that each of the fluorine-containing silica fine particles have a secondary particle average diameter of not less than 20 nm. Silica fine particles are easily available which allows each of the fluorine-containing silica fine particles to have a secondary particle average diameter of not less than 20 nm. Hence, according to the above structure, great cost and efforts are not required in manufacturing the fluorine-containing silica fine particles.

The following explains experiments conducted to verify the effects of the present invention.

[Experiment 1]

Examined in the present experiment was how the toner adhesion prevention property changes according to the particle diameters of the fluorine-containing silica fine particles coating the inner circumferential surface of each toner bottle. In the following, for ease of explanation, the member called "toner container" in the above embodiment will be referred to as "toner bottle".

In the present experiment, as each toner bottle, MX-70TB made of an HDPE resin and provided by Sharp Corporation was used. Further, the fluorine-containing silica fine particles used for the coating were set to have a secondary particle average diameter of 20 nm in Example 1, 30 nm in Example 2, 35 nm in Example 3, 40 nm in Example 4, 48 nm in Example 5, and 55 nm in Example 6. Further, a toner bottle not coated with the fluorine-containing silica fine particles was also prepared (Comparative Example 1).

The secondary particle average diameter refers to an average particle diameter of "aggregated" (in appearance) Fine particles (secondary particles) when the particles (primary particles) are dispersed onto the inner circumferential surface of the toner bottle. The secondary particle average diameter was measured by using, as a measuring apparatus, Zetasizer Nano-ZS90 provided by Sysmex Corporation. The Zetasizer employs the photon correlation spectoroscopy. In this case, a measurement range was set to fall within a range from 2 nm to 300 nm.

The toner bottles were coated by spraying the below-mentioned coating liquid and drying it sufficiently. Each of the coat layers of the toner bottles was set to have a thickness of 1.5 μm. Note that the thickness of the coat layer was measured by using an eddy current type film thickness meter CTR-1500E provided by Sanko Electronic Laboratory Co. Ltd. In the measurement, a measurement range was set at 0.1 μm.

(Coating Liquid)

- 1 part by weight of silica particles (Aerosil RY812 provided by Shin-Etsu Chemical Co. Ltd in Example 1, Aerosil RY300 provided by Shin-Etsu Chemical Co. Ltd in Example 2, Aerosil RY380 provided by Shin-Etsu Chemical Co. Ltd in Example 3, Aerosil R976S provided by Shin-Etsu Chemical Co. Ltd in Example 4, PL-1 provided by Fuso Chemical Co. Ltd. in Example 5, and PL-3 provided by Fuso Chemical Co. Ltd. in Example 6)
- 0.07 part by weight of a fluorine-based silane coupling agent (KP-801M provided by Shin-Etsu Chemical Co. Ltd)
- 0.1 part by weight of a silicone-acryl-based resin (KP541 provided by Shin-Etsu Chemical Co. Ltd)
- 0.001 part by weight of a vinyl acetate resin (Polysol provided by Showa Highpolymer Co. Ltd)
- 95.9 parts by weight of ethanol Then, 1000 g of toner (MX-70JTBA provided by Sharp Corporation) was contained in each of the coated toner bottles (Examples 1 to 5) and the uncoated toner bottle (Comparative Example 1), and each of the toner bottles was set in a complex machine (MX-5500 provided by Sharp Corporation). Thereafter, printing of test images was sequentially carried out.

Note that the complex machine used in the experiment used a two-component developer, and had a developing device supplied with MX-70JRTBA, a developer including the aforesaid toner and carrier.

Then, it was checked how many sheets had been printed until the adhesion of toner started in the toner bottle. Table 1 below shows the results.

Criteria of the evaluation were as follows: "×" indicates a case where the number of printed sheets was less than 100000 when the adhesion of toner started, "Δ" indicates a case where the number of printed sheets was not less than 100000 but less than 150000, and "○" indicates a case where the number of printed sheets was not less than 150000.

TABLE 1

| | Coating | Primary Particle Average Diameter (nm) | The Number of Printed Sheets Until Occurrence of Adhesion (1000 sheets) | Evaluation |
|---|---|---|---|---|
| Example 1 | Done | 20 | 160 | ○ |
| Example 2 | Done | 30 | 180 | ○ |
| Example 3 | Done | 35 | 190 | ○ |
| Example 4 | Done | 40 | 205 | ○ |
| Example 5 | Done | 48 | 200 | ○ |
| Example 6 | Done | 55 | 140 | Δ |
| Comparative Example 1 | Not done | — | 80 | X |

As shown in Table 1, it was verified that the adhesion of toner can be effectively prevented by coating a toner bottle with the fluorine-containing silica fine particles. Further, it was found to be preferable that the fluorine-containing silica fine particles used for the coating have a secondary particle average diameter of 50 nm or less.

[Experiment 2]

Examined in the present experiment was how the toner adhesion prevention property changes according to the thickness of a coat layer, by using coat layers that were respectively formed on the inner circumferential surfaces of the toner bottles, that contained the fluorine-containing silica fine particles, and that had various thicknesses.

The thicknesses of the coat layers are 0.2 μm in Example 7, 0.3 μm in Example 8, 0.5 μm in Example 9, 1.5 μm in Example 10 (the same as Example 2), 3.0 μm in Example 11, and 3.5 μm in Example 12. Further, as the fluorine-containing silica fine particles, the fluorine-containing silica fine particles used in Example 2 of Experiment 1 above (i.e., particles having a secondary particle average diameter of 30 nm) were used. Other conditions were the same as those in Experiment 1.

As with Experiment 1, toner was contained in each of the coated toner bottles, and the toner bottle was set in a complex machine. Then, printing of test images was sequentially carried out, and it was checked how many sheets had been printed until the adhesion of toner started in the toner bottle. Table 2 below shows the results.

As with Experiment 1, criteria of the evaluation were as follows: "X" indicates a case where the number of printed sheets was less than 100000 when the adhesion of toner started, "Δ" indicates a case where the number of printed sheets was not less than 100000 but less than 150000, and "○" indicates a case where the number of printed sheets was not less than 150000.

TABLE 2

| | Coating | Thickness of Coat Layer (μm) | The Number of Printed Sheets Until Occurrence of Adhesion (1000 sheets) | Evaluation | Note |
|---|---|---|---|---|---|
| Example 7 | Done | 0.2 | 110 | Δ | |
| Example 8 | Done | 0.3 | 155 | ○ | |
| Example 9 | Done | 0.5 | 170 | ○ | |
| Example 10 | Done | 1.5 | 180 | ○ | |
| Example 11 | Done | 3.0 | 195 | ○ | |
| Example 12 | Done | 3.5 | — | — | *1 |
| Comparative Example 1 | Not Done | — | 80 | X | |

*1 The coat layer was detached and was mixed with the developer, thereby deteriorating the image property.

As shown in Table 2, it was found to be preferable that the thickness of the coat layer containing the fluorine-containing silica fine particles be 0.3 μm or more. However, when the thickness of the coat layer containing the fluorine-containing silica fine particles exceeds 3.0 μm, the coat layer is likely to be detached and cause image deterioration. As such, it was found to be preferable that the thickness of the coat layer be not more than 3.0 μm.

As described above, a toner container of the present invention including a cylindrical portion, which contains toner used in an electrophotographic type image forming apparatus and is driven to rotate so as to let the toner out via the outlet, includes: a layer, which is provided on an inner wall of the cylindrical portion and contains a fluorine-containing particle obtained by coupling a surface of a silica particle with a fluorine compound.

According to the above structure, the layer containing the fluorine-containing particle is provided on the inner wall of the cylindrical portion of the toner container, so that it is possible to prevent the toner from being adhered to the inner wall of the cylindrical portion of the toner container. Further, the fluorine-containing particle can be manufactured to have a sufficiently small particle diameter with ease, by using a silica particle having a small particle diameter. Such a silica particle having a small particle diameter is available or manufactured with ease. Thus, as compared with the technique of Patent Document 2, it is possible to prevent the adhesion of toner more effectively.

It is preferable to arrange the toner container such that: the fluorine-containing particle has a secondary particle average diameter of not more than 50 nm. According to the above structure, the secondary particle average diameter of the fluorine-containing particle is sufficiently small, so that the inner wall of the cylindrical portion is rendered more flat. This prevents the adhesion of toner more effectively.

It is preferable to arrange the toner container such that: the fluorine-containing particle has a secondary particle average diameter of not less than 20 nm. According to the structure above, it is possible to manufacture the fluorine-containing particle with ease.

The fluorine-containing particle may be obtained by modifying a property of the surface of the silica particle by using at least a fluorine-based silane coupling agent. According to the above structure, the fluorine-containing particle having a small diameter can be manufactured easily with low cost.

Further, it is preferable that the layer have a thickness of not less than 0.3 μm but not more than 3 μm. According to the above structure, the layer containing the fluorine-containing particle has a thickness of not less than 0.3 μm, so that it is possible to obtain a sufficient toner adhesion prevention property. Further, the thickness of the layer is restricted to be not more than 3 μm. This prevents the layer from being detached, being mixed with the toner, and accordingly causing image deterioration.

Further, an image forming apparatus of the present invention includes: the toner container; a driving section for driving to rotate the cylindrical portion of the toner container; and an image forming section for forming an image in accordance with an electrophotographic method by using the toner getting out via the outlet.

The image forming apparatus includes the aforesaid toner container, and can therefore effectively use the toner through its life, thereby attaining resource saving.

The present invention is not limited to the description of the embodiments and examples above, but may be altered by a skilled person within the scope of the claims. An embodiment based on a proper combination of technical means disclosed in different embodiments is encompassed in the technical scope of the present invention.

Further, a value range other than the value ranges described in this specification is encompassed in the present invention as long as the value range is reasonable in terms of the content of the present invention.

What is claimed is:

1. A toner container including a cylindrical portion, which contains toner used in an electrophotographic type image forming apparatus and is driven to rotate so as to let the toner out via the outlet, comprising:

a layer, which is provided on an inner wall of the cylindrical portion and contains a fluorine-containing particle obtained by coupling a surface of a silica particle with a fluorine compound.

2. The toner container as set forth in claim 1, wherein:

the fluorine-containing particle has a secondary particle average diameter of not more than 50 nm.

3. The toner container as set forth in claim 2, wherein:

the fluorine-containing particle has a secondary particle average diameter of not less than 20 nm.

4. The toner container as set forth in claim 1, wherein:

the fluorine-containing particle is obtained by modifying a property of the surface of the silica particle by using at least a fluorine-based silane coupling agent.

5. The toner container as set forth in claim 1, wherein:

the layer has a thickness of not less than 0.3 μm but not more than 3 μm.

6. An image forming apparatus, comprising:

a toner container including a cylindrical portion, which contains toner used in an electrophotographic type image forming apparatus and is driven to rotate so as to let the toner out via the outlet, the toner container including a layer, which is provided on an inner wall of the cylindrical portion and contains a fluorine-containing particle obtained by coupling a surface of a silica particle with a fluorine compound;

a driving section for driving to rotate the cylindrical portion of the toner container; and an image forming section for forming an image in accordance with an electrophotographic method by using the toner getting out via the outlet.

* * * * *